211-56 SR
10/22/85 OR 4,548,324

United States Patent [19]

Mackey, Jr.

[11] Patent Number: 4,548,324

[45] Date of Patent: Oct. 22, 1985

[54] TABLE AND LITERATURE DISPLAY STAND

[75] Inventor: Sherman E. Mackey, Jr., Celina, Ohio

[73] Assignee: S & K Products Co. Inc., Coldwater, Ohio

[21] Appl. No.: 571,883

[22] Filed: Jan. 18, 1984

[51] Int. Cl.[4] ..... A47F 7/00

[52] U.S. Cl. ..... 211/58; 211/129; 211/163

[58] Field of Search ..... 211/58, 55, 163, 131, 211/129, 126, 77, 56

[56] References Cited

U.S. PATENT DOCUMENTS

| | | | |
|---|---|---|---|
| 188,954 | 3/1877 | Richmond | 211/58 |
| 406,548 | 7/1889 | Terrill | 211/58 X |
| 689,213 | 12/1901 | Nicholson | 211/163 X |
| 790,440 | 5/1905 | Klein | 211/45 |
| 838,294 | 12/1906 | Zeiner | 211/58 |
| 929,714 | 8/1909 | Schlegel | 211/58 |
| 955,589 | 4/1910 | Fassio | 211/56 |
| 1,235,225 | 7/1917 | Miller | 211/58 |
| 1,432,277 | 10/1922 | Cahusac | 211/56 |
| 1,937,142 | 11/1933 | Carson | 211/58 |
| 2,443,320 | 6/1948 | Meyer | 211/56 |
| 2,690,843 | 10/1954 | Ament | 211/58 X |

*Primary Examiner*—Ramon S. Britts
*Assistant Examiner*—Sarah A. Lechok
*Attorney, Agent, or Firm*—Biebel, French & Nauman

[57] ABSTRACT

A combination table and rotating literature display stand comprising a base having a post extending upwardly therefrom, a table top mounted on an upper end of the post, and a plurality of rack members rotatably mounted on the post and positioned to form a closed structure. Each of the rack members includes a plurality of compartments shaped to hold printed material. Each compartment includes a lower pocket shaped to receive the lower portion of a piece of printed material and a rod extending upwardly and outwardly from the pocket for supporting an upper portion of a piece of printed material such that indicia appearing on a face of the printed material in the pocket is not significantly obscured.

12 Claims, 6 Drawing Figures

TABLE AND LITERATURE DISPLAY STAND

BACKGROUND OF THE INVENTION

The present invention relates to display devices and, more particularly, to rotating display devices adapted to hold and display printed material such as magazines and having a stationary table top.

In waiting rooms, sales offices, merchandise display areas and the like, it is often desirable to provide a supply of magazines, sales brochures or other promotional literature to be read by the patrons of the establishment. Typically, such printed material is kept on a table top so that it is easily accessible to all who enter the waiting area, show room or sales office. However, a distinct disadvantage with this method of display is that, as a result of repeated reading and perusal by the patrons, the material soon falls into disarray on the table top, and gives the room a cluttered look. Furthermore, should several types of promotional literature be arranged on the table top in distinct stacks, repeated perusal by patrons will result in a disorganized pile in which it is difficult to retrieve any particular type of printed material.

A similar problem may arise in the home. Chairside or bedside reading tables supporting books and magazines quickly take on a cluttered appearance after the books and magazines have been read and scattered about the table top.

One solution to this problem in the commercial area is to provide wall mounted display racks which comprise a plurality of vertical columns of pockets, each pocket containing a set of printed material of one type, such as sales brochures. However, a disadvantage with this type of arrangement is that the waiting room, show room or sales office is not always designed to accommodate a display rack of such dimensions, and such a display rack is often of necessity placed at a location which is removed from the seating area of the patrons, making it inconvenient for them to reach the material.

Possible solutions to this problem may be found in analogous structures, such as the bookholder disclosed in the Ruddell U.S. Pat. No. 1,930,844; the rotary storage cabinet shown in the Schecter et al. U.S. Pat. No. 3,341,226; or the jewelry display stand shown in the Strasser U.S. Pat. No. Des. 270,024. In each of these devices, the items to be displayed are mounted on a rotating drum so that a user may remain stationary and rotate the drum to view all of the items it contains.

However, there are disadvantages with each of these devices if used to display printed material such as magazines and sales brochures. For example, the rotary cabinet of the Schecter et al. patent is designed to store flat items in a radially extending position relative to the drum, making it somewhat difficult to view the outer cover of each item. The same is also true for the bookholder of the Ruddell patent. With the Strasser device, the number of items to be displayed is somewhat limited since the items are arranged in vertical columns and are not held in a shingled relation to reduce the height of the display stand necessary to hold a predetermined number of items in a vertical column.

Accordingly, there is a need for a rotating display stand which is specifically designed to hold magazines, periodicals, sales brochures and the like which has a plurality of distinct pockets for the ordered and organized storage of the printed material. Furthermore, there is a need for a display stand in which the literature can be stored such that the message on the front page or cover of the literature is easily viewed by patrons. There is also a need for a display cabinet which can function as a table so that it can be incorporated into the furniture normally found in waiting rooms, show rooms, sales offices, or as a chairside or bedside table for the home.

SUMMARY OF THE INVENTION

The present invention is a combination table and literature display stand which comprises a base, a table top mounted on the base, and a plurality of rack members rotatably mounted on the base beneath the table top. Each of the rack members includes a plurality of compartments arranged in vertical columns and shaped to receive printed literature such as magazines, sales brochures, promotional material and the like. Each compartment consists of a lower pocket shaped to receive a lower portion of a piece of printed material and a frame for supporting an upper portion of a piece of printed material such that the indicia appearing on a face of the printed material in the pocket is not substantially obscured, and can be viewed by a user.

In a preferred embodiment, the base includes a substantially flat support surface and a support post extending upwardly from the surface. The table top is rigidly mounted on an upper end of the support post, and the rack members are rotatably attached to the post. The rack members preferably are held between a lower support member, which is supported on the post by thrust bearings, and an upper support member which is journaled on the support post. The rack members preferably are positioned adjacent the outer periphery of the lower support member and are oriented on that member to form a substantially closed structure. A plurality of vertically oriented dividers are used to close the spaces between adjacent rack members.

Each rack member is fabricated as an integral unit having a plurality of vertically oriented compartments which retain printed material in a shingled relationship so that the use of vertical space is maximized. The integral construction of the rack members facilitates the rapid assembly of the display stand, as well as the replacement of a damaged rack member.

One of the advantages of the preferred embodiment of the invention is that each rack member includes a plurality of transverse members which extend between a pair of opposing, vertically oriented channels. Each transverse member consists of a downwardly and rearwardly inclined front wall, a rearwardly inclined rear wall extending downwardly from the front wall, and a floor extending outwardly from the rear wall. Consequently, a relatively few transverse members are required to form a plurality of compartments.

Another advantage of the preferred embodiment is that the frame associated with each pocket consists of a rod having ends journaled into holes formed in the pockets, opposing side portions extending upwardly and outwardly from the pocket, and a central portion having a curvilinear shape so that printed material of different heights within the pocket may be supported. The transverse members forming the pockets include shoulders and the side portions of the rods include jogs which are positioned to engage the shoulders and thereby lock the rods to the pockets. However, the locking engagement between the rods and pockets is such that the rods may be removed relatively easily from the pockets for cleaning or replacement.

Accordingly, it is an object of the present invention to provide a combination table and literature display stand which is designed to store literature and other printed material in an orderly and easily maintained arrangement; which stores and displays literature such that the material appearing on the cover or face of the literature is viewed easily by a user; in which the various components can be assembled relatively easily and in which the components can be replaced relatively easily if damaged; and a table and literature display stand which maximizes the use of vertical space and includes a stationary table top at an elevation suitable for use as an end table in a waiting room, show room or home.

Other objects and advantages of the invention will be apparent from the following description, the accompanying drawings and the appended claims.

DETAILED DESCRIPTION OF THE PREFERRED EMBODIMENT

Figure 1:
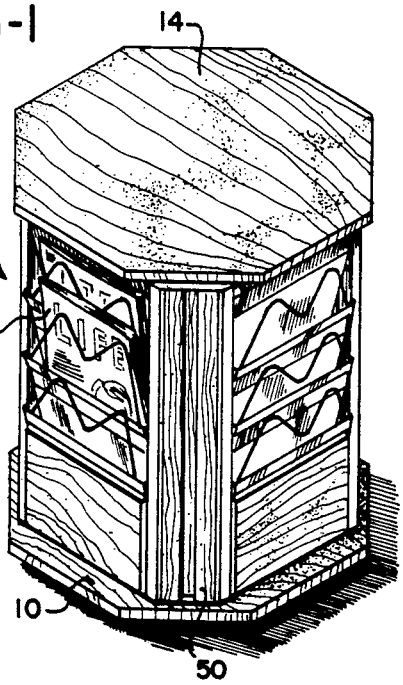
FIG. 1 is a perspective view of a table and literature display stand showing a preferred embodiment of the invention.

A preferred embodiment of the table and literature display stand is shown in FIG. 1. The display stand includes a base 10, rack means 12 and a table top 14. As shown more clearly in FIGS. 2 and 6, the base 10 includes a substantially flat support surface 16 and a support post 18 extending upwardly therefrom. The support surface 16 includes a pair of feet 20 which are secured to its underside by wood screws 22. The support post 18 preferably is a section of tubing which is threaded into or welded to a flange 24 that is attached to the center of the support surface 16 by wood screws 25.

Figure 2:
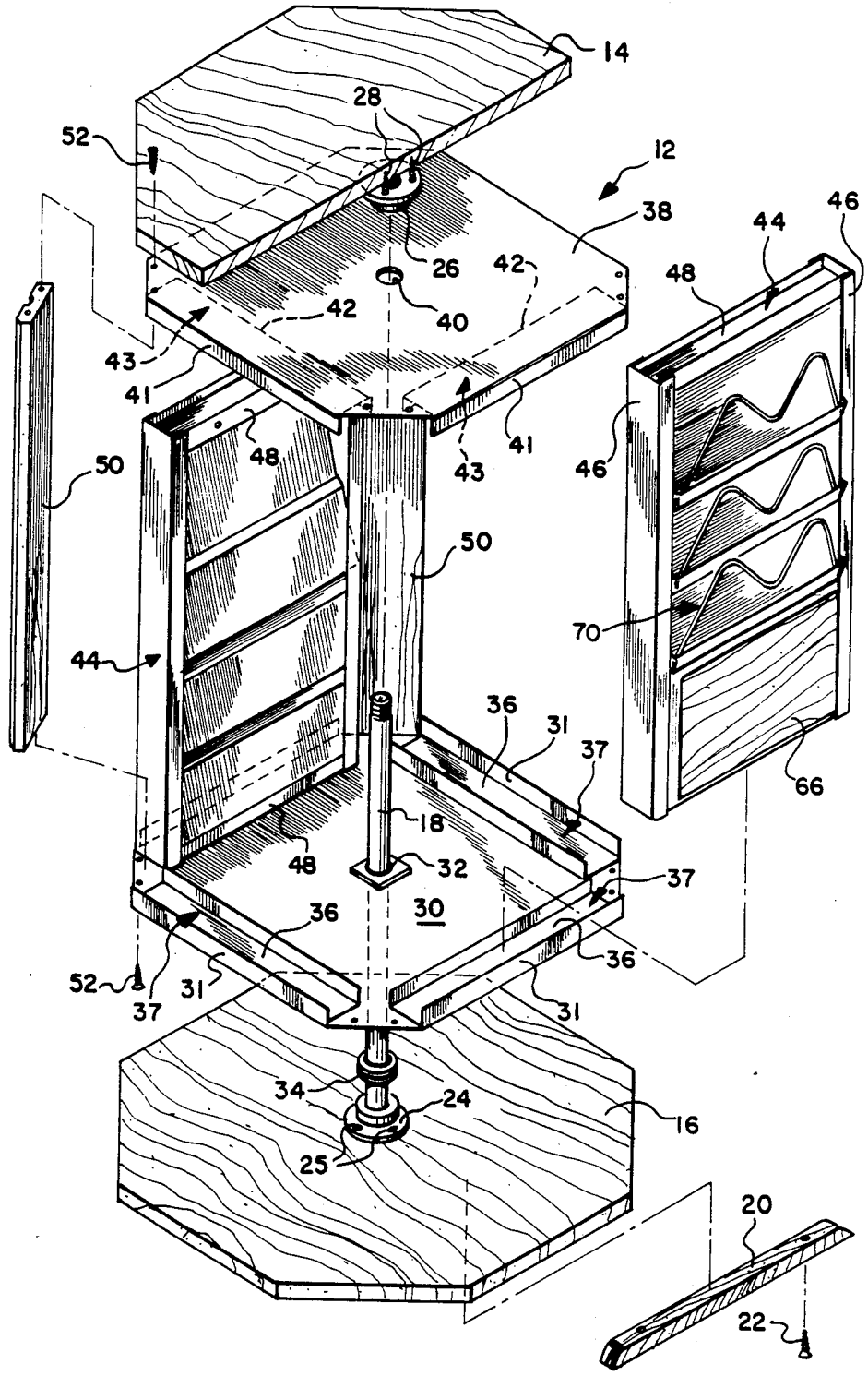
FIG. 2 is an exploded view of the embodiment shown in FIG. 1.

The upper end of the post 18 is threaded into a second pipe flange 26 which is attached to the underside of the table top 14 by wood screws 28. It should be noted that, while the support surface 16 and table top 14 shown in FIGS. 1, 2 and 6 are octagonal in shape, these components may have a hexagonal, square, circular or other shape depending upon the particular styling desired, and not depart from the scope of the invention.

As shown in FIGS. 2, 3, 4 and 6, the rack means 12 includes a lower support member 30 which is generally square in shape having L-shaped outer flanges 31 and includes a central reinforced hole 32 shaped to receive the support post therethrough. The lower support member 30 rests on thrust bearings 34 which in turn engage a shoulder of the pipe flange 24. The lower support member 30 includes four L-shaped angles 36 which are attached to an upper surface of the support member, preferably by tack welding or other permanent means. Angles 36 are positioned adjacent the flanges 31 of the support member 30 to form U-shaped channels 37.

An upper support member 38 also forms a part of the rack means 12 and is similar in construction to the lower support member 30. Upper support member 38 is identical in structure to lower support member 30 and includes a central reinforced hole 40 which receives the support post 18 therethrough, four L-shaped flanges 41 positioned about its periphery, and four L-shaped angles 42 attached to an underside of the support member by permanent means such as tack welding to form U-shaped channels 43. The upper and lower support members 38, 30, respectively, are oriented such that the channels 42, 36, respectively, form vertically spaced pairs.

Figure 6:
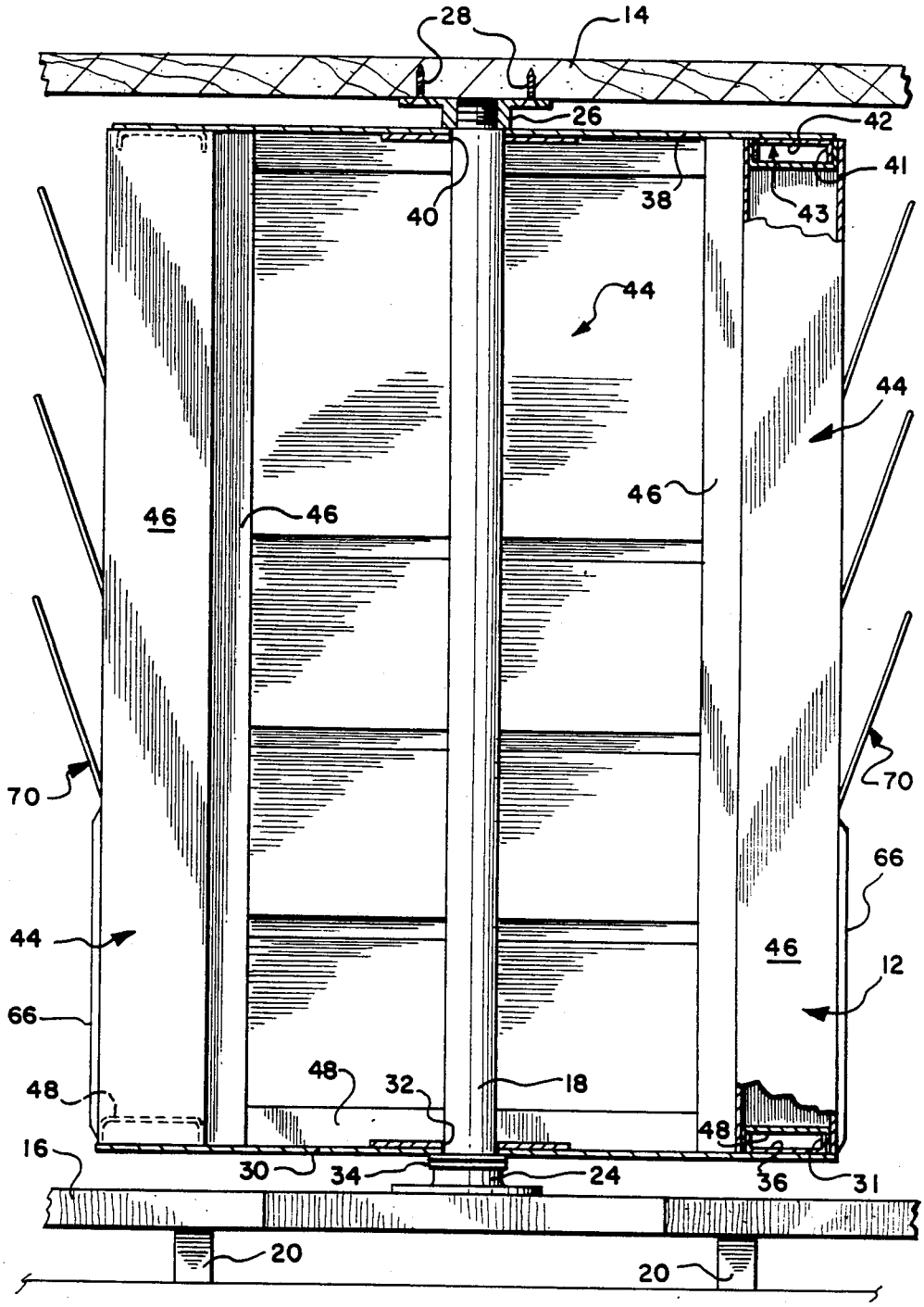
FIG. 6 is a side elevation, partially in section, of the embodiment of FIG. 1 in which a rack member has been removed and portions of another rack member are broken away.

The rack means also includes four rack members, generally designated 44, which are best shown in FIGS. 2, 3, 4 and 6. The rack members 44, which are identical to each other in construction, each include a pair of vertically extending, opposing channels 46 which are joined at their upper and lower ends by transverse channels 48 which open upwardly and downwardly, respectively. The rack members 44 are attached to the upper and lower support members 38, 30, respectively, such that the U-shaped channels 42, 36 nest within the upper and lower transverse channels 48, preferably in a slight interference fit, as best shown in FIG. 6. The rack members 44 are thereby positioned to form a closed structure.

Four dividers 50 are shaped and positioned to cover the gaps between adjacent rack members, and extend between the upper and lower support members 38, 30. The corners of the upper and lower support members are cut to follow the upper and lower edges of the dividers 50, and the dividers are secured to the support members by wood screws 52. In addition to enhancing the aesthetic appearance of the stand, the dividers 50 close the rack means 12 to provide a tension binder to secure the assembled structure. Again, although the preferred embodiment shows rack means 12 having four rack members 44, it is within the scope of the invention to provide rack means shaped to accommodate three, six or eight rack members, simply by changing the shape of the periphery of the upper and lower support members.

Figure 4:
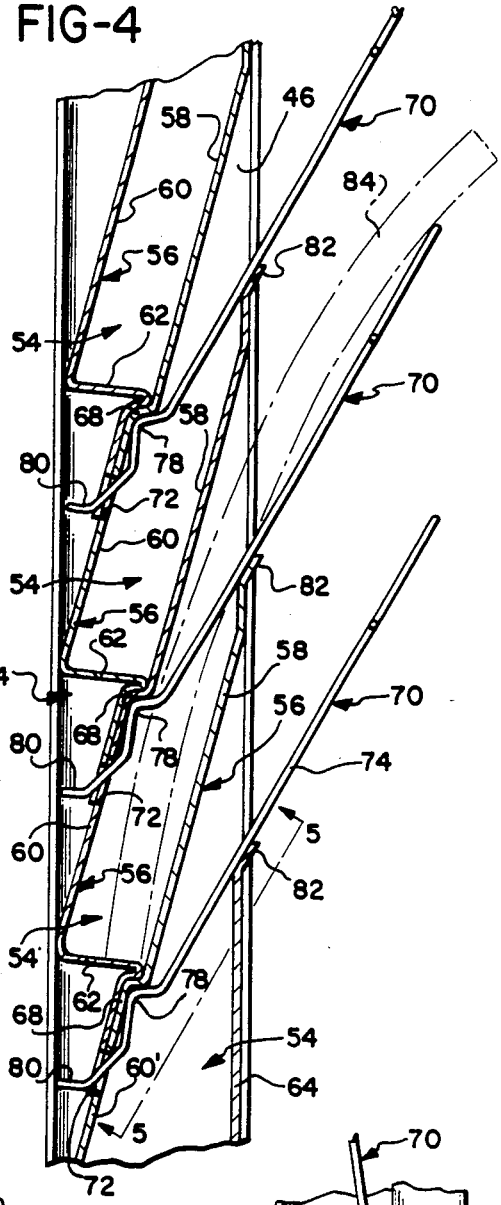
FIG. 4 is a detail side elevation in section of a rack member taken at line 4—4 of FIG. 3.
Figure 3:
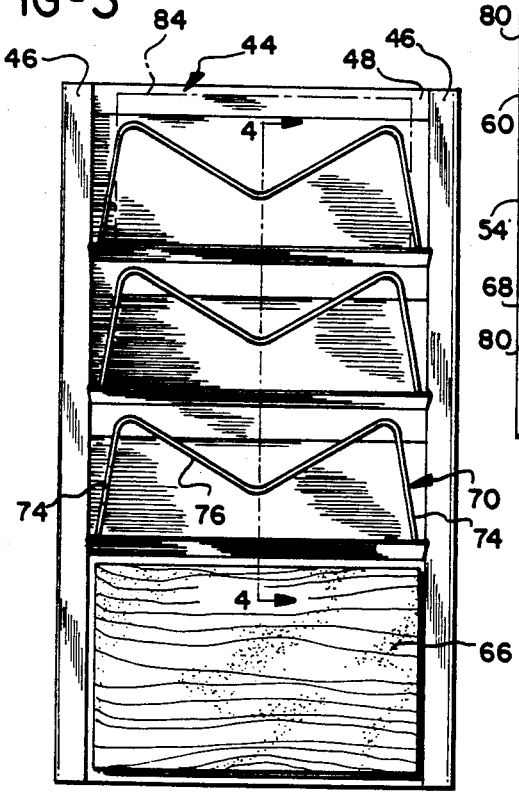
FIG. 3 is a front elevation of a rack member of the embodiment shown in FIG. 1.
Figure 5:
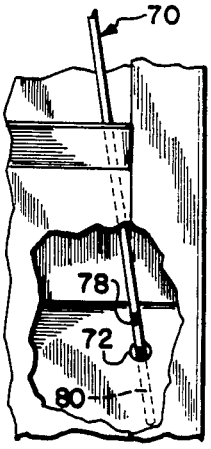
FIG. 5 is a detail showing the connection between a frame member and a pocket in which a portion of the rack member is broken away, taken at line 5—5 of FIG. 4.

Each rack member 44 includes several compartments, generally designated 54, and best shown in FIGS. 3, 4 and 5. The compartments are formed by transverse members 56 which extend between the vertical channels 46 of the rack members 44. Each transverse member 56 preferably comprises a single piece of sheet metal, bent to form a downwardly and rearwardly inclined front wall 58, a rearwardly inclined rear wall 60 extending downwardly from the front wall, and a floor 62 extending outwardly from a lower portion of the rear wall. The rear wall 60' of the lowermost compartment 54 is covered by a front plate 64 which extends between the vertical channels 46, and may include a decorative panel 66 attached to its outer surface.

The transverse members 56 are arranged in a shingled relation such that the compartments 54 are formed by the rear wall 60 of one transverse member and the front wall 58 of a next lower transverse member. Each transverse member 56 rests on creases in a next lower member which form shoulders 68. Transverse members 56 are secured to channels 46 by tack welding, rivets or other suitable means.

The compartments 54 also include frame means, each of which consists of a rod 70 formed so that its ends may be inserted through holes 72 (see FIGS. 4 and 5) formed in the rear walls 60 of the transverse members 56. The rods 70 are identical to each other in structure, and each includes a pair of opposing side portions 74, and a central portion 76 having a curvilinear shape. The side portions include jogs 78 (FIGS. 4 and 5) which are sized and positioned so as to provide for forceable engagement with the shoulders 68 when the ends 80 of the side portions 74 are inserted in the holes 72.

The side portions 74 are also supported by the front walls 58 of the transverse members 56, as well as the front plate 64, the upper edges thereof forming lips 82 which engage the side portions. The rods 70 are thus supported in the compartments 54 by the engagement of the ends 80 with the holes 72 and vertical channels 46, the engagement of the jogs 78 with the shoulders 68, and the engagement of the side portions 74 with the lips 82.

The resulting structure of the compartments 54 includes a lower pocket which is shaped to receive a piece of printed material 84 (shown in FIGS. 3 and 4) and an upper frame portion which supports the upper portion of the printed material such that a substantial portion of the indicia printed on the outer surface or cover can be viewed by a user. It should also be noted that the curvilinear shape of the central portion 76 of the rods 70, which in the preferred embodiment is in the shape of an "M", is such that the frame can support printed material having varying heights; that is, shorter material will be supported by the lower, middle section of the central portion 76, while taller material will be supported by the ends of the central portion, as shown in FIG. 4.

The construction of the preferred embodiment of the table and display stand provides for a rigid and firmly supported table top 14 which remains stationary as the rack means 12 is rotated by a user to bring different ones of the rack members 44 into view. Therefore, the table top 14 is suitable for supporting lamps, ashtrays and the like, as well as for permanent attachment of lamps. Tubular support post 18 provides for passage of electric lamp wire through top 14 and base 16.

While the form of apparatus herein described constitutes a preferred embodiment of the invention, it is to be understood that the invention is not limited to this precise form of apparatus, and that changes may be made therein without departing from the scope of the invention.

What is claimed is:

1. A table and literature display stand comprising:

a base having a substantially flat support surface and a support post extending upwardly therefrom;

a table top attached to an upper end of said post;

rack means including upper and lower support members rotatably attached to said post so that said rack means may be rotated while said table top remains stationary, a plurality of rack members attached at upper and lower ends thereof to said upper and lower support members, respectively, said rack members being positioned on said lower support member to form a substantially closed structure, and a plurality of vertically oriented dividers to cover spaces between adjacent ones of said rack members and increase stability of said rack means, said dividers being attached at upper and lower ends thereof to said upper and lower support members, respectively, said upper and lower support members including a plurality of channels adjacent to outer edges thereof and positioned in vertically spaced opposing pairs, each of said opposing pairs of channels and associated ones of said dividers holding a rack member therebetween;

each of said rack members having a plurality of compartments arranged in vertical columns, said compartments each having a lower pocket shaped to receive a lower portion of a piece of printed material:

frame means for supporting an upper portion of a piece of material positioned within each of said pockets such that indicia appearing on a face of printed material in said pocket is not substantially obscured thereby, said frame means including a plurality of rods, each having ends attached to an associated one of said pockets, opposing side portions extending upwardly and outwardly from said associated pocket and a central portion having a curvilinear shape such that printed material of different heights within said associated pocket may be supported thereby; and said rack members each including a pair of opposing vertical channels and a plurality of transverse members extending therebetween, each of said transverse members having a downwardly and rearwardly inclined front wall, a rearwardly inclined rear wall extending downwardly from said front wall, and a floor extending outwardly from said rear wall, said transverse members being positioned in shingled relation.

2. The apparatus of claim 1 wherein said transverse members each include a downwardly-opening transverse shoulder; said side portions of said frame means each include a downwardly-opening jog shaped and sized to engage said shoulder when said frame ends are inserted in said rear wall, thereby securing said rod to said associated pocket; and said front walls of said transverse members each include a lip portion at an upper end thereof shaped to support said side portions of an associated one of said rods above said jogs.

3. The apparatus of claim 2 wherein said rear walls include holes shaped to receive said ends of said rod therethrough.

4. The apparatus of claim 3 wherein said holes are shaped such that said rod ends abut flanges of said vertical channels when positioned in said holes.

5. A table and literature display stand comprising:

a base;

a table top mounted on said base;

rack means having a plurality of rack members rotatably mounted on said base beneath said table top, said rack members each including a pair of opposing open-faced vertical channels and a plurality of transverse members within said channels, said transverse members each having a downwardly and rearwardly inclined front wall, a rearwardly inclined rear wall extending downwardly from said front wall, and a floor extending radially outwardly from said rear wall, said transverse members being arranged in shingled relation to form a plurality of compartments arranged in vertical columns such that said floor of one of said transverse members contacts said front wall of a next lower one of said transverse members, said compartments being sized to receive printed material therein, and;

further comprising frame means attached to and extending radially outwardly from said rear walls such that said frame means extends over and is supported by said front walls, whereby upper portions of material within said compartments may be supported therby.

6. The apparatus of claim 5 wherein said rack means includes a lower support member rotatably mounted on said base, said rack members being attached to said lower support member adjacent outer edges thereof.

7. The apparatus of claim 6 wherein said rack members are positioned on said lower support member to form a substantially closed structure; and said rack means includes a plurality of vertically oriented dividers to cover spaces between adjacent ones of said rack members and increase stability of said rack means.

8. The apparatus of claim 7 wherein said rack means includes an upper support member rotatably mounted on said base and attached to said rack members at upper ends thereof, said dividers being attached at upper and lower ends thereof to said upper and lower support members, respectively.

9. The apparatus of claim 8 wherein said base includes a substantially flat support surface and a support post extending upwardly therefrom such that said table top is attached to an upper end of said post and said upper and lower support members are rotatably attached to said post so that said rack means may be rotated while said table top remains stationary.

10. The apparatus of claim 9 wherein said upper and lower support members include a plurality of channels adjacent to outer edges of said support members and positioned in vertically spaced opposing pairs, each of said opposing pairs of channels and associated ones of said dividers holding a rack member therebetween.

11. The apparatus of claim 10 wherein said frame means includes a plurality of rods, each of said rods having ends attached to an associated one of said compartments, opposing side portions extending upwardly and outwardly from said associated compartment and a central portion having a curvilinear shape such that printed material of different heights within said associated compartment may be supported thereby.

12. A table and literature display stand comprising:

a base;

rack means having a plurality of rack members rotatably mounted on said base, said rack members each including a pair of opposing open-faced vertical channels and a plurality of transverse members received with said channels, said transverse members each having a downwardly and rearwardly inclined front wall, a rearwardly inclined rear wall extending downwardly from said front wall, and a floor extending radially outwardly from said rear wall, said transverse members being arranged in shingled relation to form a plurality of compartments arranged in vertical columns such that said floor of one of said transverse members contacts said front wall of a next lower one of said transverse members, said compartments being sized to receive printed material therein, and;

further comprising frame means attached to and extending radially outwardly from said rear walls such that said frame means extends over and is supported by said front walls, whereby upper portions of material within said compartments may be supported thereby.

* * * * *

UNITED STATES PATENT AND TRADEMARK OFFICE

CERTIFICATE OF CORRECTION

PATENT NO. : 4,548,324

DATED : October 22, 1985

INVENTOR(S) : Sherman E. Mackey, Jr.

It is certified that error appears in the above-identified patent and that said Letters Patent is hereby corrected as shown below:

Column 1, line 45, "3,341,226" should be --3,341,266--.

Column 6, line 49, "shaped" should be --spaced--.

Column 6, line 58, insert --received-- before "within".

Signed and Sealed this

*Eighth* Day of *April 1986*

[SEAL]

*Attest:*

DONALD J. QUIGG

*Attesting Officer*

*Commissioner of Patents and Trademarks*